United States Patent [19]

Akashi

[11] 4,110,891

[45] Sep. 5, 1978

[54] METHOD OF ATTACHING A SEPARABLE BOTTOM END STOP TO A PAIR OF SLIDE FASTENER STRINGERS

[75] Inventor: Shunji Akashi, Kurobe, Japan

[73] Assignee: Yoshida Kogyo K.K., Japan

[21] Appl. No.: 818,869

[22] Filed: Jul. 25, 1977

[30] Foreign Application Priority Data

Jul. 27, 1976 [JP] Japan ..... 51/89328

[51] Int. Cl.[2] ..... B23P 11/00

[52] U.S. Cl. ..... 29/408; 29/33.2; 29/766; 29/767; 264/252

[58] Field of Search ..... 29/408, 409, 766, 767, 29/768, 33.2; 264/252; 425/DIG. 34, 517

[56] References Cited

U.S. PATENT DOCUMENTS

| | | | |
|---|---|---|---|
| 2,464,050 | 3/1949 | Morin | 264/252 |
| 2,511,397 | 6/1950 | Day | 264/252 X |
| 2,546,649 | 3/1951 | Morin | 264/252 X |
| 3,488,239 | 1/1970 | Heimberger | 29/408 X |
| 3,714,698 | 2/1973 | Fukuroi | 29/408 |
| 3,818,575 | 6/1974 | Johnston | 29/408 |

*Primary Examiner*—Victor A. DiPalma
*Attorney, Agent, or Firm*—Bucknam and Archer

[57] ABSTRACT

A separable bottom end stop having a pin member and a box member is attached to a pair of slide fastener stringers each comprising a row of helically coiled coupling elements supported on and along one side of a marginal edge of a stringer tape, there being a filler cord extending in and along the row of coupling elements. In preparation for the mounting of each of the pin member and the box member, a length of the row of coupling elements is removed, and the exposed filler cord portion and element-free tape portion are pressed together so that the exposed filler cord portion remains in substantial alignment with a portion of the cord which extends over the element-supporting stringer portion, and the element-free tape portion is bent into pressed contact with the exposed filler cord portion. The pin member and the box member are injection-molded on the element-free tape portions and the exposed filler cord portions of the stringers. The attached pin member and pin part of the box member lie substantially flush with the fastener stringers so that the slider can slide smoothly onto the pin member and pin part.

2 Claims, 8 Drawing Figures

METHOD OF ATTACHING A SEPARABLE BOTTOM END STOP TO A PAIR OF SLIDE FASTENER STRINGERS

BACKGROUND OF THE INVENTION

1. Field of the Invention

The present invention relates to a method of attaching a separable bottom end stop to a pair of slide fastener stringers having a pair of rows of helically coiled coupling elements supported on and along one sides of a pair of stringer tapes.

2. Prior Art

One well known type of separable bottom end stop comprises a box member and a pin member both made of metal or plastic material, the members being secured in gripping engagement with element-free edges of a pair of slide fastener stringer tapes. The attached pin member and pin part of the box member have lower portions projecting beyond the surfaces of the stringer tapes. When this type of bottom end stop is used on a slide fastener having helically coiled coupling elements sewn to upper sides of the stringer tapes, the projecting lower portions of the bottom end stop lie in the way of the bottom wing of the slider that is slidable along the flat reverse sides of the stringer tapes. Thus, the movement of the slider becomes arrested or very sluggish as the slider comes into abutment with the projecting portions of the box and pin members.

In order to rectify this problem, it is known to form as by injection-molding the pin member and the pin part of the box member on only one side of the stringer tapes thereby avoiding the formation of the projections that would otherwise interfere with the slider as it approaches the bottom end stop. The one-sided bottom end stop however is relatively weak in bonding strength and cannot withstand rough usage over a long period of time.

SUMMARY OF THE INVENTION

According to the invention, a length of each row of helically coiled elements is taken away from a stringer tape with an exposed portion of a filler cord being left on the tape. The element-free portions of the tapes are then bent with heat and pressure into pressed contact with the exposed filler cords that are substantially aligned with portions of the filler cords which extend through the helically coiled elements on the stringer tapes. A pin member and a box member having pin part are mounted on the element-free tape portions, the pin member and the pin part being substantially equal in thickness to and lying substantially flush with element-supporting portions of the slide fastener stringers.

An object of the present invention is to provide a method of attaching a separable bottom end stop to a pair of slide fastener stringers, the bottom end stop having a pin member and pin part of a box member which are formed so as to be devoid of projections that would otherwise be in the way of the movement of a slider.

Another object of the present invention is to provide a method of attaching a separable bottom end stop to a pair of slide fastener stringers with an increased degree of bonding strength.

These and other objects and advantages of the invention will become apparent from the description and accompanying drawings.

DETAILED DESCRIPTION OF THE PREFERRED EMBODIMENT

Figure 1:
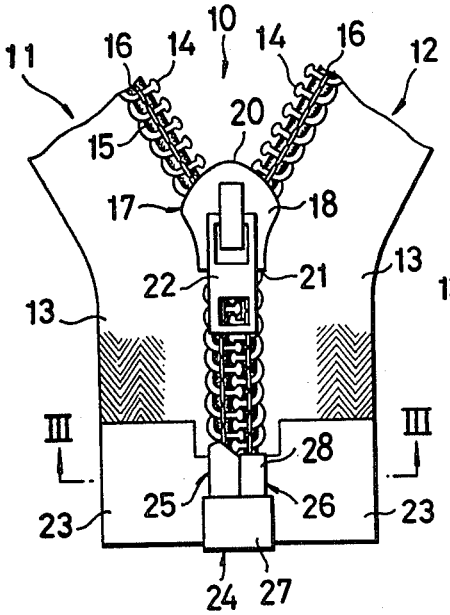
FIG. 1 is a fragmentary plan view of a slide fastener having a slider and a separable bottom end stop mounted in accordance with the present invention.
Figure 2:
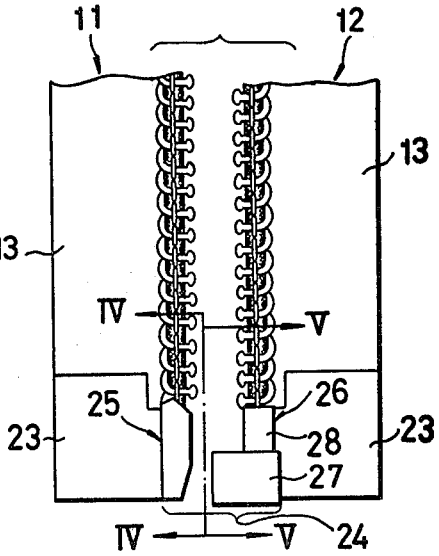
FIG. 2 is a fragmentary plan view of the separated slide fastener with the slider removed for clarity.

FIG. 1 shows a separable slide fastener 10 comprising a pair of fastener stringers 11, 12 each including a stringer tape 13 and a row of helically coiled coupling elements 14 mounted on and along one side of a marginal edge of the stringer tape 13. A filler cord 15 extends centrally in and through the row of coupling elements 14. The coupling elements 14 are sewn to the stringer tape 13 with a thread 16 passing through the filler cord 15. The filler cord 15 acts as a reinforcement for the coupling elements 14 to be fixed with a required degree of positional stability against the danger of displacement during use over a prolonged period of time.

A slider 17 includes a top wing 18 and a bottom wing 19 (FIG. 3) between which there is provided a substantially Y-shaped guide channel (not shown) for the passage therethrough of the rows of coupling elements 14 on the opposed stringer tapes 13, 13. The slider 17 has a front end 20 where the rows of coupling elements 14 go into and out of the guide channel in uncoupled state and a rear end 21 where the rows of coupling elements 14 go into and out of the guide channel in coupled state. To open the slide fastener 10, the slider 17 is moved downwardly as viewed in FIG. 1 by pulling a pull tab 22 pivoted to the top wing 18 until the slider 17 arrives at the bottom end of the slide fastener 10.

The stringer tapes 13, 13 are reinforced at their bottom end portions as by a pair of plastic films 23, 23, respectively, bonded or otherwise fixed to the bottom end portions. A separable bottom end stop 24 comprises a pin member 25 and a box member 26 having a box part 27 and a pin part 28, the pin member 25 being partly received in the box part 27. The pin member 25 and the box member 26 formed by injection-molding plastic material on the stringer tapes 13, 13 in gripping or clamping engagement with the stiffened marginal edge portions. When the slide fastener 10 is to be separated, the opposed rows of coupling elements 14 are disengaged from each other along their entire lengths, and then the pin member 25 is pulled out of the box part 27 of the box member 26, thereby separating the bottom end stop 24.

Figure 4:
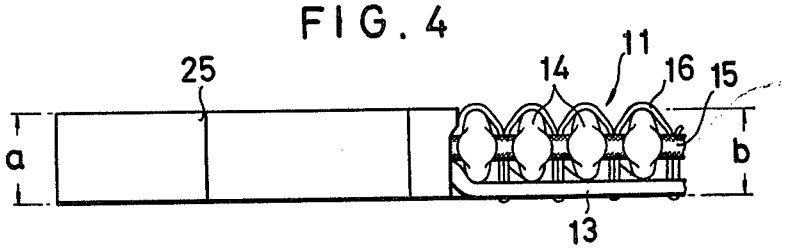
FIG. 4 is an enlarged side-elevational view taken in the direction of arrows IV — IV of FIG. 2.
Figure 5:
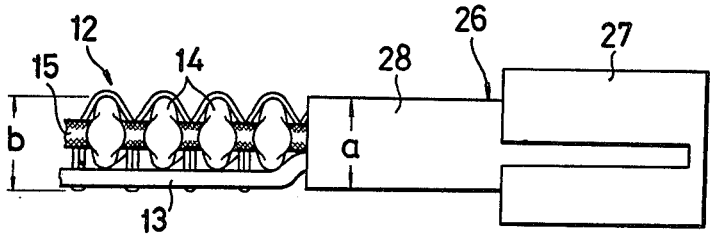
FIG. 5 is an enlarged side-elevational view taken in the direction of arrows V — V of FIG. 2.

As shown in FIGS. 4 and 5, the pin member 25 and the pin part 28 of the box member 26 have a thickness *a* which is substantially the same as a thickness *b* of element-supporting portions of the fastener stringers 11. Further, the pin member 25 and the pin part 28 lie substantially flush with the element-supporting stringer portions.

Figure 6:
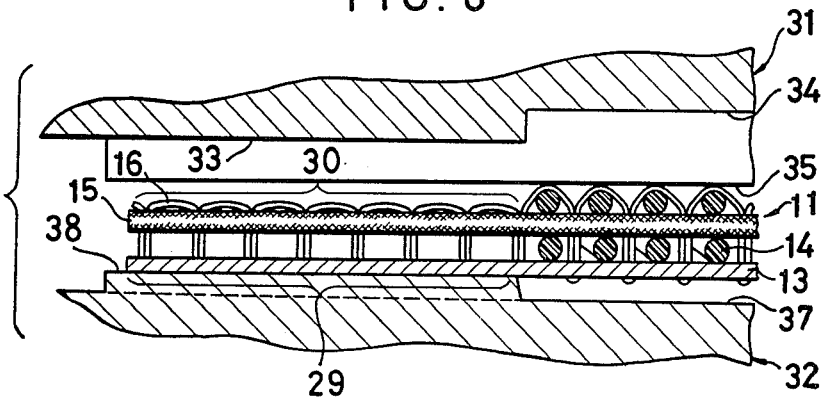
FIGS. 6 through 8 are enlarged fragmentary cross-sectional views showing successive steps to attach a pin member of a separable bottom end stop to one of a pair of fastener stringers.
Figure 7:
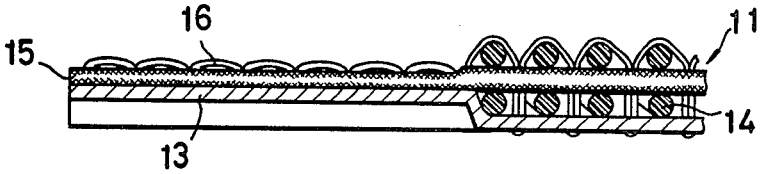
Figure 8:
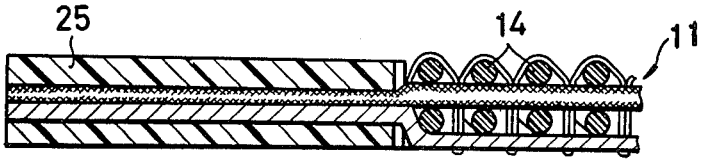

FIGS. 6 through 8 illustrate the manner in which the pin member 25 is attached to one of the stringer tapes 13, 13. In FIG. 6, a length of the row of coupling elements 14 is removed from the stringer tape 13 to provide an element-free tape portion 29, with an exposed portion 30 of the filler cord 15 being left thereon. The sewing thread 16 remains attached to the exposed filler cord portion 30 and the element-free tape portion 29. The stringer tape 13 is cut along such a line extending thereacross as to make the element-free tape portion 29 a bottom end portion of the tape 13 on which the pin member 25 is to be mounted.

To treat the element-free tape portion 29 and the exposed filler cord portion 30 in preparation for the mounting of the pin member 25 thereon, there are provided an upper die 31 and a lower die 32 spaced downwardly from the upper die 31, the upper die 31 being movable toward and away from the lower die 32. The upper die 31 has a first elongate recess 33 and a second elongate recess 34 in its bottom surface 35, the first recess 33 being for receiving the exposed cord portion 30 and the second recess 34 for receiving the element-supporting portion of the stringer. The depth of the recess 33 is substantially the same as the sum of the diameter of a leg portion of the fastener elements 14 and the thickness of the filler cord 15. The depth of the recess 34 is substantially the same as the thickness of the row of the fastener elements 14. The recesses 33 and 34 are substantially equal in width to the coupled rows of the fastener elements 14. The lower die 32 has on its top surface 37 a land 38 having a height corresponding to a spacing between the filler cord 15 and the stringer tape 13, or to the diameter of a leg portion of the coupling elements 14. The land 38 can be loosely received in the recess 33 in the upper die 31. More specifically, the width of the land 38 is smaller than that of the recess 33 approximately by a doubled tape thickness.

Figure 3:
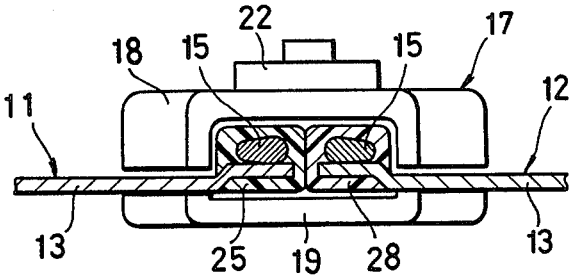
FIG. 3 is an enlarged cross-sectional view taken along line III — III of FIG. 1.

The fastener stringer is placed on the lower die 32 with the element-free tape portion 29 on the land 38. The upper die 31 is then lowered toward the lower die 32 until the bottom surface 35 of the upper die 31 presses down the stringer tape 13 against the top surface 37 of the lower die 32. At this time, the element-supporting stringer portion is received between the recess 34 and the top surface 37. The exposed filler cord portion 30 and the element-free tape portion 29 are compressed in sandwiched relation between the bottom of the recess 33 in the depressed upper die 31 and the land 38 of the lower die 32. The parameters of the recess 33 and the land 38 are such that when under compression the exposed filler cord portion 30 is held in substantial alignment with a portion of the filler cord 15 which extends over the element-supporting stringer portion, and the element-free tape portion 29 is bent out of the general plane of the stringer tape 13 into pressed contact with the exposed filler cord portion 30, as shown in FIG. 7. The element-free tape portion 29 is bent only at its margin along which the slider 17 is movable (FIG. 3). During pressing operation, the upper and lower dies 31, 32 are heated as by means of an ultrasonic or a high-frequency heater, thereby retaining the compressed shape of the filler cord portion 30 and tape portion 29 as durably as possible.

After the pressing operation, the pin member 25 is injection-molded on the bent tape portion 29 and the exposed filler cord portion 30 in clamping or sandwiching relation therewith. The pin member 25 is substantially equal in thickness to and lies substantially flush with the element-supporting stringer portion.

The box member 26 is mounted on the other stringer tape 13 in the same manner as with the pin member 25.

A separable bottom end stop made of metal can be secured by staking to the compressed element-free tape portion 29 and exposed filler cord portion 30 in gripping engagement therewith.

With the arrangement of this invention, the pin member 25 and the pin part 28 of the box member 26 have no parts projecting out of alignment with the general plane of the fastener stringers 11, 12; that is, no parts lying in the way of the movement of the slider 17, with the results that the slider 17 can slide smoothly onto the bottom end stop 24. Further, the pin member 25 and the pin part 28 are fixed in clamping engagement with the marginal edges of the tapes 13, 13 for positional stability over long periods of time against dislodgment therefrom.

Although the present invention has been described in detail with particular reference to a preferred embodiment thereof, it will be understood that variations and modifications can be effected within the scope of the appended claims.

What is claimed is:

1. A method of attaching a separable bottom end stop having a pin member and a box member including pin part to a pair of slide fastener stringers including a pair of stringer tapes supporting on and along one sides of their confronting marginal edges a pair of rows of helically coiled elements having filler cords extending therethrough, comprising the steps of:

(a) removing a length of each of said rows of helically coiled elements from said stringer tapes to provide a pair of element-free tape portions with exposed portions of said filler cords left thereon;

(b) bending with heat and pressure said pair of element-free tape portions into pressed contact with said exposed portions of the filler cords, said exposed portions being held in substantial alignment with those portions of said filler cords which are disposed in said rows of helically coiled elements; and (c) mounting said pin member and said box member on said pair of element-free tape portions, respectively, said pin member and said pin part being substantially equal in thickness to and lying substantially flush with element-supporting portions of said slide fastener stringers.

2. A method according to claim 1, in which said pair of element-free tape portions are bent only at their confronting marginal edges.

* * * * *